United States Patent [19]

Kainer

[11] Patent Number: 4,672,899

[45] Date of Patent: Jun. 16, 1987

[54] PREBURNING PLANT FOR BURNING SOLID FUEL MATERIALS HAVING A HIGH ASH CONTENTS

[76] Inventor: Ernst Kainer, A-2832 Thernberg 23, Austria

[21] Appl. No.: 876,869

[22] PCT Filed: Sep. 16, 1985

[86] PCT No.: PCT/AT85/00030

§ 371 Date: May 19, 1986

§ 102(e) Date: May 19, 1986

[87] PCT Pub. No.: WO86/01874

PCT Pub. Date: Mar. 27, 1986

[30] Foreign Application Priority Data

Sep. 17, 1984 [AT] Austria ..... A2950/84

[51] Int. Cl.[4] ..... F23B 7/00

[52] U.S. Cl. ..... 110/234; 110/110; 110/229; 110/258

[58] Field of Search ..... 110/234, 235, 229, 258, 110/102, 110, 230

[56] References Cited

U.S. PATENT DOCUMENTS

| | | | |
|---|---|---|---|
| 3,865,053 | 2/1975 | Kulze et al. | 110/102 X |
| 4,312,278 | 1/1982 | Smith et al. | 110/234 |
| 4,559,882 | 12/1985 | Dobson | 110/102 X |
| 4,562,777 | 1/1986 | van der Voort | 110/234 |

FOREIGN PATENT DOCUMENTS 2604409 8/1977 Fed. Rep. of Germany .

*Primary Examiner*—Edward G. Favors

*Attorney, Agent, or Firm*—Toren, McGeady and Goldberg

[57] ABSTRACT

The preburning plant for burning solid fuel materials having a high ash contents, particularly barks or cut wood chips, is comprised of a hearth (10) downwardly delimited by a grid (15), supplied with fuel material by a hopper (6). The hearth (10) communicates with the boiler (2) by a combustion channel (11). Inside the cladding (9) and above the combustion channel (11), a vertical axis ring (19) is arranged above the grid (15) for fuel material degassing purposes. The ring is rotatingly driven, preferably periodically, so that an endless screw (26) conveys the fuel material to the hearth (10).

22 Claims, 4 Drawing Figures

PREBURNING PLANT FOR BURNING SOLID FUEL MATERIALS HAVING A HIGH ASH CONTENTS

The invention refers to a pre-furnace heating plant for the combustion of solid combustible material of high ash content, in particular of bark and wood chips, which comprises a furnace chamber confined at its bottom by a grate and receiving the combustible material from above via a storage compartment, said furnace chamber being surrounded by a mantle of refractory material, a combustion channel connecting the furnace chamber with a succeeding boiler and extending through the mantle and having an opening for supplying secondary air, in the mantle there being provided a further opening for supplying primary air below the grate, this further opening being preferably closeable by means of a control flap being controlled by the boiler.

It is known that various combustible materials of high ash content, in particular wood bark, wood chips from sawmills and from agriculture, and also wet garbage, can not be burned in normal boilers for central heatings, because due to the permanent cooling effect of the heat carrier fluid (water) flowing through the mantle of the boiler, the furnace chamber can not be brought to the temperature required for the combustion of such a combustible material. Thus, a prefurnace burning equipment of the initially described type has become known for burning such a combustible material, which equipment is connected with its combustion channel to the furnace chamber of the central-heating boiler which acts as a heat exchanger. It is a drawback of the known equipment that frequently the combustible material forms an arch within the storage compartment and that the equipment can only be maintained operative for a short time interval of approximately one hour, whereupon the whole equipment must be cleaned on account of the highcontent in ash and in noxious matter of the combustible material, in particular wood bark. This operation is laboursome and troublesome and, in addition, no heat is supplied to the central-heating boiler during the cleaning period.

It is an object of the present invention to avoid the mentioned drawbacks and to improve a pre-furnace heating equipment of the initially described type such that arching within the storage compartment and thus also disturbances of the combustion process are avoided, and that also the efficiency of the equipment and the utilization of the combustible constituents of the combustible material are substantially improved. The invention solves this task by the fact that a gasifier ring is provided within the mantle and at a distance above the grate, which gasifier ring has an upright axis and has its top surface inclined in direction towards its central opening, and a worm member extending in direction towards this opening, said gasifier ring being rotatable around its axis by a drive means, so that the worm member conveys the combustible material through the opening of the gasifier ring. By this relative movement between gasifier ring and worm, the combustible material resting on the gasifier ring over a relatively large area is reliably taken along for rotation and is conveyed by the worm into the furnace chamber so that the combustible material located within the storage compartment and above the gasifier ring is loosened up and any arching of this material is destroyed, so that the combustible material is reliably fed into the furnace chamber. Thus it is ensured that always a sufficient amount of combustible material is present within the furnace chamber and that the combustion proceeds to the desired extent. It is thus not only avoided that the first within the furnace chamber is extinguished, but the furnace chamber or its wall, respectively, are always maintained at the temperature most favourable for the combustion process, which is just of importance for the combustion of problematic combustible material, in particular wood bark. Preferably, the worm member extends through the opening of the gasifier ring, whereby also an arching or bridging of the combustion material within the gasifier ring can be reliably avoided. The worm member can also be driven for rotation, but according to a preferred embodiment of the invention it is more favourable in view of a reduced expenditure, if the worm member is stationary and is held at its upper end by a rod located within a hollow shaft connected to the gasifier ring to the drive means for the gasifier ring. This arrangement is particularly efficient and of simple construction. The rod holding the worm member and the hollow shaft support themselves one against the other. Intermittent rotation of the gasifier ring is energy-saving and is, as a rule, sufficient for reliably providing the furnance chamber with combustible material and for avoiding troublesome arching. By geared motor it is easy to achieve the desired rotational speed of the gasifier ring.

An advantageous further development of the invention consists in that the hollow shaft is provided within the storage compartment with laterally protruding projections, for example with resilient prongs. These projections loosen the combustible material within the storage compartment and contribute to avoid arching of the combustible material.

A preferred embodiment of the invention consists in that the gasifier ring can be lifted and lowered for changing its distance from the grate. In this manner, the volumetric capacity of the furnace chamber can be varied, which provides a further possibility for the control of the equipment in addition to the control of the supply of primary air and secondary air particularly from the draught regulator of the boiler. The mentioned height adjustment of the gasifier ring can be effected without any problems and with an only low energy expenditure by lifting or lowering, respectively, the hollow shaft.

Rotation of the gasifier ring can, however, also be used for a further purpose: If, according to the invention, a grate scraper is provided between the grate and the gasifier ring which grate scraper rotates relatively to the grate, this results in stripping residues off the grate, so that the grate need be cleaned only less frequently. Preferably, the grate scraper comprises at least one bar sliding over the grate. In this case, the arrangement may be such that the grate scraper has vertical rods being longitudinally guided within openings of the gasifier ring. This simple construction ensures that the grate scraper is reliably taken along when rotating the gasifier ring and allows height adjustment of the gasifier ring at any time. However, the grate can also be coupled with the gasifier ring and the grate rotate, while the grate scraper remains stationary. According to a simple construction this can be achieved by providing the grate with vertical rods which are guided in openings or peripheral grooves of the gasifier ring for longitudinal motion in order to allow the mentioned height adjustment of the gasifier ring. For making the worm member fully effective also in the uppermost position of the gasifier ring, i.e. if the furnace chamber has its maximum volumetric capacity, the worm member may, according to a further feature of the invention, extend in the lowermost position of the gasifier ring into the hollow shaft for the length of the stroke of the gasifier ring. In this manner, effective pitches of the worm member are at disposal even it the hollow shaft, and therewith the gasifier ring, is lifted. The worm member may consist of a metal strip twisted around its longitudinal axis, which must only consist of a material which is sufficiently temperature-resistent.

Further features and advantages of the invention can be seen from the description of embodiments of the invention which are schematically shown in the drawings.

Figure 1:
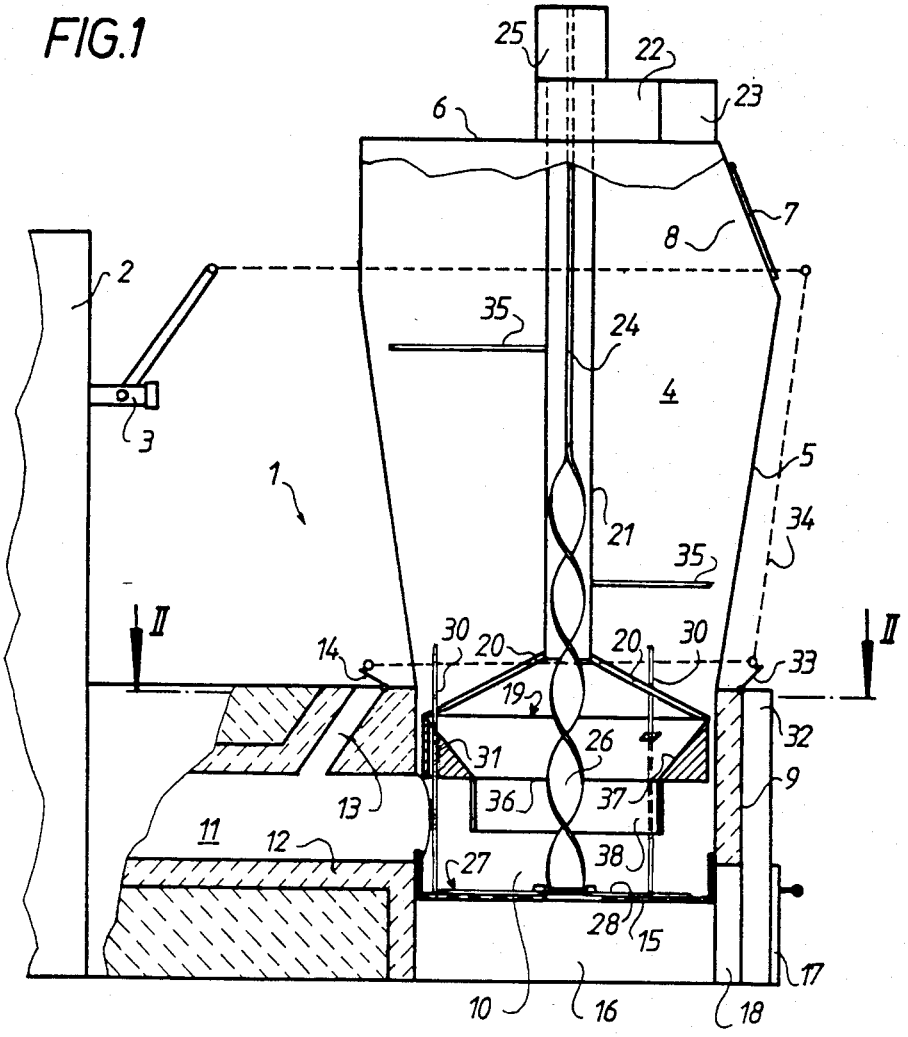
FIG. 1 shows a first embodiment of the invention in a vertical section.
Figure 3:
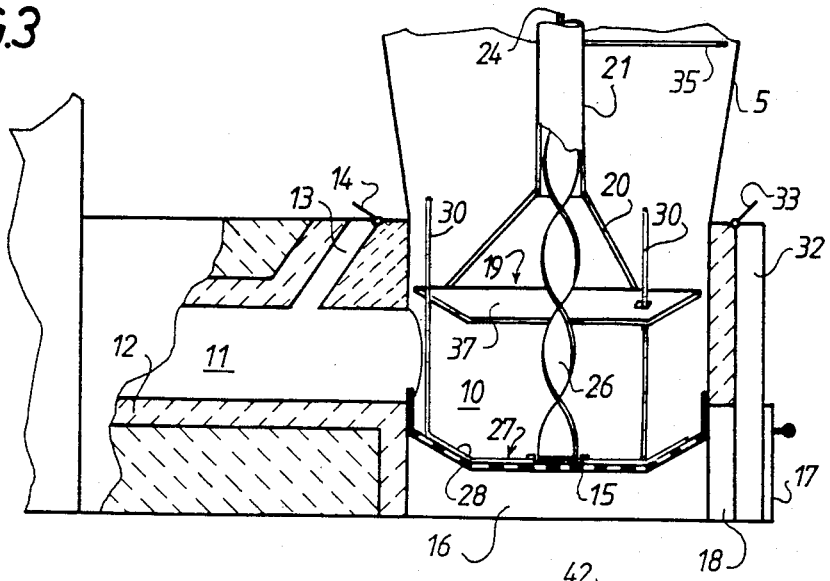
Figure 4:
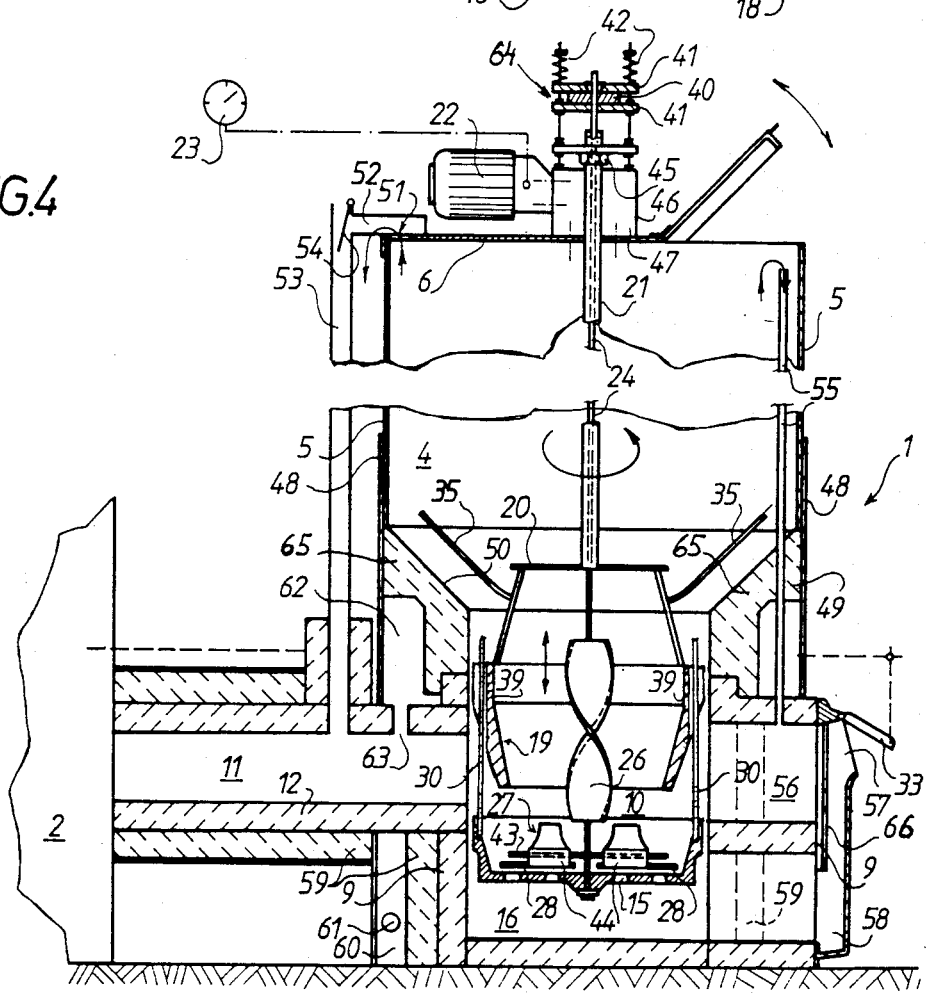

The FIGS. 3 and 4 show, in sections similar to FIG. 1, two modified embodiments.

Figure 2:
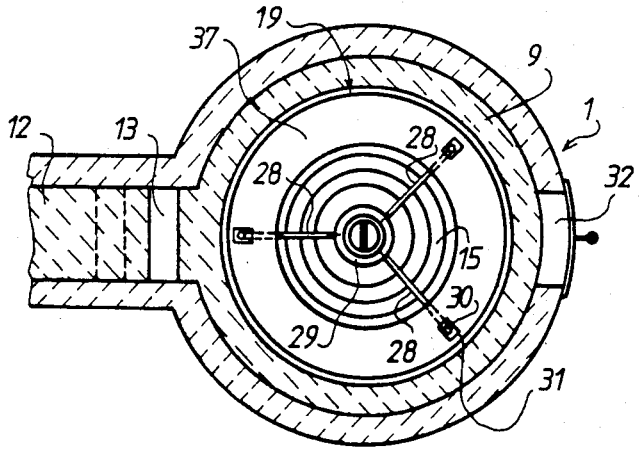
FIG. 2 is a section along line II—II of FIG. 1.

The pre-furnace burning equipment 1 as shown in the FIGS. 1 and 2 is lined up with a central-heating boiler 2 and is controlled by the draught regulator 3 thereof in a manner to be later described in detail. The equipment 1 has a storage compartment 4 for receiving the combustible material to be burned, in particular wood bark, saw dust, wood chips, but also domestic garbage (also wet, but without ceramic or metallic components). This combustible material can optionally be mixed with coal dust. The storage compartment 4 is confined by a housing 5 expanding in upward direction like a funnel and being closed on its top by a cover wall 6. At the front side an opening 8 for charging the storage shaft 4 is provided which opening 8 can be closed by means of a charging door 7. The housing 5 extends downwardly in the shape of a circular annular mantle 9 of refractory material, for example refractory concrete, which mantle encloses a furnace chamber 10 in which the combustible material is burnt. A combustion channel 11 passing through the mantle 9 extends from the furnace chamber 10 to the boiler 2, said combustion channel being equally surrounded by a refractory mantle 12 through which extends an opening 13 for the supply of secondary air. The opening 13 can be closed by a lid 14.

The furnace chamber 10 is confined on its bottom by a grate 15 which has through-passages for the ash, said passages being arranged around the axis of the furnace chamber 10 along arcs of a circle, which ash falls into an ash chamber 16 which is accessible through an opening 18 within the mantle 9, said opening being closeable by means of a cleaning door 17.

Within the circular mantle 9 and above the grate 15, spaced apart from this a gasifier ring 19 is provided which is arranged concentrically relative to the axis of the furnace chamber 10 and can be rotated around this axis. For this purpose, the gasifier ring 19 is fixed to a hollow shaft 21 by means of struts 20, which hollow shaft extends upwardly within the storage compartment 4 and is supported for rotation and for being shiftable in longitudinal direction in the cover wall 6. This hollow shaft 21 is driven for rotation by a geared motor 22 being intermittently energized and deenergized by a time switch 23, so that the hollow shaft 21, together with the gasifier ring 19, is intermittently rotated. Within the interior of the hollow shaft 21 there is located a rod 24 which is supported in a manner described later on in detail at its upper end by a head piece 25 of the geared motor 22. This supporting is later on described in detail in connection with FIG. 4. At its lower end the rod 24 carries a worm member 26, the lower end of which may be fixed to the grate 15, particularly then, if the worm member 26 stands still. The hollow shaft 21 is height-adjustible by means of an adjusting gearing not shown and adjustable in the selected position so that the height position of the gasifier ring 19 within the mantle 9 and therewith the height of the furnace chamber 10 located below the gasifier ring 19 can be adjusted.

A grate scraper 27 contacts the upper side of the grate 15 and has three bars 28 sliding over the grate 15 and extending radially in outward direction from a ring 29 surrounding the lower end of the worm member 26. The outer ends of these bars 28 carry upwardly protruding carrier bolts 30, which extend through openings 31 of the gasifier ring 19 and are guided within these openings so that they can be shifted in longitudinal direction. In this manner, the grate scraper 27 is taken along for rotation as soon as the gasifier ring 19 is rotated and scrapes the grate 15 free of contaminations by means of the bars 28.

Primary air is supplied to the furnace chamber 10 through the grate 15 from below, this air flowing through a passage 32 within the mantle 9 and through the opening 18 into the ash chamber 16 and, respectively, to the grate 15. The upper end of the passage 32 can be closed by a lid 33. Both lids 14, 33 are controlled by the draught regulator 3 of the boiler 2 such that, in dependence on the boiler temperature, the lid 14 controlling the supply of secondary air is closed and the lid 33 controlling the supply of primary air is opened, or vice versa. The corresponding control lines 34 provided for this purpose are schematically indicated by dashed lines.

The combustible material charged into the storage compartment 4 via the charging opening 8 accumulates within the storage shaft 4 above the gasifier ring 19. An account of the heat generated within the furance chamber 10 and within the combustion channel 11, the mantle 9 and the gasifier ring 19, equally consisting of refractory material, are heated up to a comparatively high temperature, which results not only in pre-drying the combustible material located within the storage compartment 4, but also in degasifying of at least those portions of combustible material which rest on the gasifier ring 19. A further pre-heating of the combustible material is achieved by the hot metallic worm member 26 which conducts the heat from the furnace chamber 10 to the storage compartment 4. The thus generated gases are sucked by the draught generated by the chimney via the central-heating boiler 2 and via the combustion channel 11 into the combustion channel 11 and are burnt there. The required combustion air is supplied via the primary air channel 32 and, respectively, or via the secondary air channel formed by the opening 13. The degree of combustion within the furnace chamber 10 can be controlled by the mentioned air supply from the draught regulator 3 of the boiler 2, on the one hand, and by height adjustment of the gasifier ring 19, on the other hand. Arching of the combustible material within the storage shaft 4 is reliably prevented on account of the fact that, on the one hand, the combustible material is at least intermittently moved by the projections 35, having the shape of resilient prongs horizontally protruding from the hollow shaft 1, and that, on the other hand, the gasifier ring 19 forms a supporting surface for the combustion material which is intermittently rotated around its vertical axis, so that the combustible material slides into the furnace chamber 10 along the top surface 37 of the gasifier ring 19 in direction to its central opening 36, which top surface is inclined toward this central opening. In order to accumulate the combustible material in the furnace chamber 10 as well as possible in the shape of a heap, the gasifier ring 19 is provided with a collar 38 extending downwardly from its opening 36, which collar holds the combustible material together which slides into the furnace chamber 10. This collar 38 can be formed by a short tube.

The worm member 26 can in a simple manner be designed as a twisted metal strip, which draws the combustible material, taken along for rotation by the rotation of the gasifier ring 19, into the opening 36 of the gasifier ring 19. For better accomodating the upper end of the worm member 26, the hollow shaft 21 can have a greater diameter in its lowermost portion accommodating this worm end.

The embodiment according to FIG. 3 differs from that according to the FIGS. 1 and 2 essentially only in the design of the gasifier ring 19, of the grate 15 and of the grate scraper 27. According to FIG. 3, the gasifier ring 19 consists of a hollow truncated cone, in particular of a temperature-resistent metallic or ceramic material. The volumetric capacity of the furnace chamber 10 located below the gasifier ring 19 is thus increased within the marginal areas of the gasifier ring 19. In a similar manner, the grate 15 is upwardly inclined in its marginal area, so that there results a central, trough-shaped depression for the burning material. Accordingly, also the radial bars of the grate scraper 27 are upwardly inclined within the marginal area, so that the grate 15 is cleaned over its total top surface.

The equipment can be provided with an additional worm conveying the combustible material from a great storage container located outside of the housing 5 into said housing 5. As a precaution means against burn-back, a sprinkler equipment known per se can be provided.

A further advantageous modified construction consists in that the grate 15 is suspended on the worm 26 but is nevertheless arranged within the mantle 9 for being movable in height direction. This provide the possibility to lower the grate 15 by means of the worm member 26, for example if a greater residual mass which can not be forced through the grate openings, rests on the grate. In lowered position of the grate, the residual mass can be removed through the cleaning door 17. Lowering of the grate further provides the possibility to effect an additional supply of primary air above the grate 15.

The efficiency of an equipment according to the invention is substantially higher, when compared with known equipments. No external energy is consumed with the exception of the energy required for the agitating movement and for moving the grate scraper, so that the energy requirement is very low, because it is sufficient to move the gasifier ring 19 and the grate scraper 27, respectively, for some seconds only in time intervals of approximately half an hour.

There are no difficulties to design the equipment for varying heat requirement, approximately 10,000 and 100,000 heat units, the chimney draught being sufficient and no additional measures being necessary for obtaining the draught.

It is also of advantage that the burn-up can be changed for at least 75 percent between the minimum value and the maximum value, so that the equipment can even be operated in summer time for making hot water.

A further advantage consists in that the combustion channel 11 can, within a wide range, arbitrarily be arranged relative to the supply opening 18 for primary air. The equipment can thus be better adapted to the just existing conditions.

In the embodiment according to FIG. 4, the grate 15 is rotatable, whereas the grate scraper 27 is generally stationary. For this purpose, the pot-like grate 15 is connected with the gasifier ring 19 by means of carrier bolts 30, so that the grate 15 is taken along for rotation in a similar manner as it is shown in FIG. 1 for the grate scraper 27. The carrier bolts 30 slide in longitudinal direction within vertical grooves 39 provided on the circumference of the gasifier ring 19, so that height adjustment of the grate 15 relative to the gasifier ring 19 is possible. In this case, the grate 15 is rotatably suspended on the central rod 24, the upper end of which is suspended by means of a friction coupling 64 on a housing 46 of a worm gear 47. For this purpose, the rod 24 is fixed to a fiction disc 40 being located between two friction plates 41 which are pressed one against the other by springs 42. The springs 42 surround columns provided on the cover wall of the housing 46, which columns also serve for securing the two friction plates 41 against rotation. Thus, in normal operation, the friction disc 40 is subjected to a braking action such that the rod 24 is not rotated and the grate scraper 27 fixed to this rod remains at rest. In this case, the grate scraper 27 consits of a horizontal transverse shaft 43 fixed to the rod 24, two flaps 44 being arranged for swivelling motion around this transverse shaft, each of said flaps carrying at its lower end a horizontal grate scraper bar 28 sliding over the downwardly enlarged openings of the grate 15. If a minor obstacle or a temporary obstacle is encountered, the grate scraper flaps 44 can swivel around their horizontal transverse shaft 43 until the obstacle has been removed. If a permanent obstacle is encountered, the transverse shaft 43 is, however, given a rotating movement by the grate 15 via the flaps 44 as soon as the friction resistance between the friction disc 40 and said both friction plates 41 acting on the friction disc has been overcome.

Below the friction discs 41 there is arranged on the outer side of the hollow shaft 21 an adjusting nut 45 on a threaded part of the hollow shaft 21, said adjusting nut 45 being arranged such that it can abut on the housing 46 of a worm gear 47 via which the hollow shaft 21 is rotated by the geared engine 22. This provides the possibility to adjust in heigt direction the hollow shaft 21 and also the gasifier ring 19 suspended to this hollow shaft 21 by means of struts 20. In this embodiment, the struts 20 carry resilient prongs 35, upwardly and obliquely directed into the storage compartment 4. The storage compartment 4 is delimited by a sheet metal housing 5 being seated within a clamping ring 48 holding together a plurality of sectors of a ring 49 which consists of mineral material, for example of brick, and surrounds the upper portion of the gasifier ring 19 and delimits with its downwardly and inwardly inclined top surface 50 a zone of coking gas formation. This zone extends up to the cover wall 6 of the storage compartment 4, in which there is provided an opening 51 having annexed thereto a transverse channel 52 leading to a secondary air channel 53 being open at its upper side. An adjusting flap 54 is arranged where the transverse channel 52 merges into the secondary air channel 53, which flap provides the possibility to adjust the ratio of the coking gases flowing from the transverse channel 52 into the secondary air channel 53 relative to the secondary air. The secondary air channel 53 opens into the combustion channel 11.

Furthermore, a vertical coking gas channel 55 extends within the storage compartment 4 from the uppermost area thereof till a horizontal channel 56 provided within the mantle 9 consisting of concrete. This channel 56 leads from an entry opening 57 for the supply of fresh air to the furnace chamber 10 located above the grate 15. In this channel 56 there is provided a heat insulating plate 66. A channel 58 is branched off from the channel 56 for the purpose of supplying fresh air into the ash chamber 16 located below the grate 15, this fresh air being pre-heated by the heat shielding plate 66. The channel 56 enables one to clean the furnace chamber 10.

The concrete mantle 9 is surrounded by an insulating mantle 59 which is surrounded at its outer side by a cavity 60. This cavity 60 has an inlet opening 61 for fresh air and is in connection with a recess 62 being provided within the brick ring 49 above the combustion channel 11. This recess 62 is in connection with the combustion channel 11 via a vertical channel 63.

A lid 33 is provided on the opening 57 and is adjusted by the draught regulator 3 of the boiler. A similar control means can be provided for the air inlet opening 61.

Within the embodiment according to FIG. 4, primary air can be supplied to the zone above the grate 15 as well as to the zone below the grate, for example of a small opening (not shown) is provided in the heat shielding plate 66. Because the lower most section of the gasifier ring 19 neighbours the combustion chamber 10, the gasifier ring is very hot in this section so that the combustion material contacting this gasifier ring 19 is already inflamed. In direction towards above, the gasifier ring 19 becomes cooler, however de-gases the combustion material. In the uppermost section of the gasifier ring 19 and in the region of the ring 49 the combustion material is dried and, in most cases, also degased.

The embodiment according to FIG. 4 is particularly suitable for big equipment due to the big cross section of the storage compartment 4.

I claim:

1. A combustion equipment for the combustion of solid combustible material of high ash content, comprising a furnace chamber having a grate at its bottom and receiving the combustible material from a storage compartment disposed above said furnace chamber, a mantle of refractory material surrounding said furnace chamber, a combustion channel for connecting said furnace chamber to a boiler means, said combustion channel extending through said mantle and having an opening for supplying secondary air, a further opening in the mantle for supplying primary air below the grate, a gasifier ring near said mantle and above said combustion channel and spaced at a distance above said grate, said gasifier ring having an upright axis and a central opening and a top surface, said top surface being inclined towards said central opening, a worm means extending in direction towards this opening and a drive means for rotating said gasifier ring around its axis, so that said worm means conveys the combustible material through said opening of the gasifier ring.

2. A combustion equipment as claimed in claim 1, wherein said worm means extends through said opening of said gasifier ring.

3. A combustion equipment as claimed in claim 1, wherein said worm means is stationary and held at its upper end by a rod located within a hollow shaft connected to said gasifier ring and being driven for rotation by said drive means.

4. A combustion equipment as claimed in claim 1, wherein said drive means comprises a gear engine for intermittently rotating said gasifier ring.

5. A combustion equipment as claimed in claim 3, wherein said hollow shaft is adapted for movement of laterally protruding projections arranged within said storage compartment.

6. A combustion equipment as claimed in claim 5, wherein said projections are resilient prongs.

7. A combustion equipment as claimed in claim 1, wherein said gasifier ring is arranged for being lifted and lowered in order to change its distance from the grate.

8. A combustion equipment as claimed in claim 1, further comprising a grate scraper sliding over the grate.

9. A combustion equipment as claimed in claim 8, wherein said grate scraper comprises at least one bar sliding over the grate.

10. A combustion equipment as claimed in claim 8, wherein said grate scraper is connected to the gasifier ring.

11. A combustion equipment as claimed in claim 10, wherein the grate scraper has vertical carrier bolts being guided within openings of the gasifier ring for being shifted in longitudinal direction.

12. A combustion equipment as claimed in claim 7, wherein said worm means extends in the lowermost position of the gasifier ring into the hollow shaft for the length of the stroke of the gasifier ring.

13. A combustion equipment as claimed in claim 1, wherein said gasifier ring has a triangular cross section and consists of fire brick, a collar being connected to the underside of said ring and extending downwardly from the opening of the gasifier ring.

14. A combustion equipment as claimed in claim 1, wherein said worm means comprises a worm consisting of a twisted metal strip.

15. A combustion equipment as claimed in claim 1, wherein the grate is suspended on the worm means and can be lifted and lowered together with this worm means.

16. A combustion equipment as claimed in claim 1, wherein the grate is coupled to the gasifier ring for common rotation

17. A combustion equipment as claimed in claim 16, wherein the grate has vertically extending rods guided for longitudinal movement in recesses on the periphery of the gasifier ring.

18. A combustion equipment as claimed in claim 8, wherein the grate scraper is connected to a rod carrying the worm means.

19. A combustion equipment as claimed in claim 18, wherein the rod is supported on its upper end by means of a friction coupling.

20. A combustion equipment as claimed in claim 1, further comprising a ring consisting of mineral material and positioned near the gasifier ring, said ring having a top surface which is inclined towards the gasifier ring.

21. A combustion equipment as claimed in claim 20, wherein the ring consists of at least two sectors held together by means of a metallic clamping ring.

22. A combustion equipment as claimed in claim 1, further comprising at least one channel for coking gases which leads from the storage compartment to a further channel connected to the combustion chamber.

* * * * *